US006181358B1

(12) United States Patent
Jodoin et al.

(10) Patent No.: US 6,181,358 B1
(45) Date of Patent: Jan. 30, 2001

(54) HIGH RESOLUTION PRINTBAR PIXEL GEOMETRIES

(75) Inventors: Ronald E. Jodoin, Pittsford; Thomas J. Hammond, Penfield; Henry P. Jankowski, Rochester; Robert P. Loce, Webster, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/195,888

(22) Filed: Nov. 19, 1998

(51) Int. Cl.[7] ..... B41J 2/385; G03G 13/04
(52) U.S. Cl. ..... 347/130; 347/238
(58) Field of Search ..... 347/129, 130, 347/134, 137, 238, 241, 244; 362/800

(56) References Cited

U.S. PATENT DOCUMENTS 4,325,070 * 4/1982 Akasaki et al. .
4,947,195 * 8/1990 Flynn et al. .
4,956,684 * 9/1990 Urata ..... 347/130 X
5,258,629 * 11/1993 Itoh et al. ..... 362/800 X
5,300,954 * 4/1994 Murano et al. .
5,793,405 * 8/1998 Shakuda ..... 347/238
5,896,162 * 4/1999 Taniguchi ..... 347/244
5,917,534 * 6/1999 Rajeswaran ..... 347/238
5,946,022 * 8/1999 Kamimura ..... 347/238

* cited by examiner

*Primary Examiner*—Sandra Brase

(57) ABSTRACT

Arrays of light emitting diodes, and LED printbars and electrophotographic marking machines that use arrays of light emitting diode, that have active area geometries that produce compact irradiance profiles. Compact irradiance profiles are achieved by placing the diode electrodes along the outer periphery of the light emitting active areas. When used with gradient index lenses, such light emitting diodes produce light spots having more compact irradiance profiles. When such light emitting diodes and gradient index lenses are incorporated into LED printbars, and when those printbars are used in expose stations of electrophotographic marking machines, improved composite images can result.

17 Claims, 8 Drawing Sheets

HIGH RESOLUTION PRINTBAR PIXEL GEOMETRIES

FIELD OF THE INVENTION

This invention relates to LED printbars. In particular, this invention relates to light emitting diode pixel geometries.

BACKGROUND OF THE INVENTION

Electrophotographic marking is a well-known method of copying or printing documents. Electrophotographic marking is performed by exposing a substantially uniformly charged photoreceptor with a light image representation of a desired document. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate such as a sheet of paper. The transferred toner image is then fused to the substrate, usually using heat and/or pressure, thereby creating a copy of the desired image. The surface of the photoreceptor is then cleaned of residual developing material and recharged in preparation for the production of another image.

The foregoing broadly describes black and white electrophotographic marking. Electrophotographic marking can also produce color images by repeating the above process for each color of toner that is used to make the composite color image. For example, in one color process, referred to as the REaD 101 process (Recharge, Expose, and Develop, Image On Image), a charged photoreceptor is exposed to a light image which represents a first color, say black. The resulting electrostatic latent image is then developed with black toner particles to produce a black toner image. A recharge, expose, and develop process is repeated for a second color, say yellow, then for a third color, say magenta, and finally for a fourth color, say cyan. The various color toner particles are then placed in superimposed registration so that a desired composite color image results. That composite color image is then transferred and fused onto a substrate.

One way of exposing a photoreceptor is to use an LED (light emitting diode) printbar-based exposure station. Such exposure stations are generally comprised of an elongated array of LEDs and an array of gradient index lenses that focus the light from the LEDs onto the photoreceptor. One goal of an LED print-bar based exposure station is the production of compact irradiance distributions on the photoreceptor. Deviating from compact distributions tends to increase bluriness and noise in the resultant printed image. FIG. 1 illustrates the spatial relationship between a light emitting diode 10 of an LED printbar, lens elements 12 of a gradient-index lens array, and a light spot 14 produced on a photoreceptor 15. To achieve high resolution (usually measured in spots per inch, or SPI) an LED printbar will typically have a large number of individual LEDs. Each LED images a small section, referred to as a pixel, of the latent image. By selectively driving the individual LEDs according to input video data a desired latent line is exposed. By moving the photoreceptor as lines are exposed a two-dimensional latent image results.

As shown in FIG. 1, the gradient index lens array is positioned between the light emitting diodes of the LED array and the photoreceptor. Gradient index lens arrays, such as those produced under the trade name "SELFOC" (a registered trademark in Japan that is owned by Nippon Sheet Glass Company, Ltd.) are comprising of bundled gradient index optical fibers, or rods, reference U.S. Pat. No. 3,658,407. That patent describes a light conducting rod made of glass or synthetic resin which has a cross-sectional refractive index distribution that varies parabolically outward from the center of the rod. Each rod acts as a focusing lens for light introduced at one end. Relevant optical characteristics of gradient index lens arrays are described in an article entitled "Optical properties of GRIN fiber lens arrays: dependence on fiber length", by William Lama, Applied Optics, Aug. 1, 1982, Vol. 21, No. 15, pages 2739–2746. That article is hereby incorporated by reference.

Ideally, light from a light emitting diode produces a narrow, well-defined latent image on the photoreceptor. This requires that the photoreceptor be exposed with a narrow light spot having sufficient power to fully expose the photoreceptor. A measure of the width of the light spot is the full width half maximum (FWHM) distance, the distance between the light spot's half power points. FIG. 2 illustrates various irradiance profiles from the light emitting diode 10 of FIG. 1. Assuming that the light emitting diode 10 has an exemplary active area geometry 16, the light emitting diode emits light with a radiance distribution profile 18. That light passes through the gradient index lens elements 12, which impart a spreading function 20 to the light. The result is an irradiance profile 22 that can be characterized by a FWHM distance 24, the distance between the half power points.

While LED printbar based exposure stations are generally successful, they have problems. One problem relates to degradations in irradiance profiles caused by light emitting diodes having less than ideal active area geometries. FIG. 3 illustrates the irradiance profiles from a light emitting diode having an active area geometry 26 that is less than ideal because an electrode 36 divides the active area into two sections The light emitting diode then emits light with a radiance distribution profile 28 that is distorted. That light passes through a gradient index lens array, which again imparts a spreading function 20 to the light. The result is an irradiance profile 30 having a FWHM distance 32 that is significantly greater than the FWHM distance 24 of FIG. 2.

The result of the greater FWHM distance is a wider irradiance profile than is desired. Therefore, LED printbars having light emitting diodes with geometries that produce a more compact radiance profile would be beneficial. Even more beneficial would be electrophotographic marking machines that use LED printbars having light emitting diodes with a geometry that produces a more compact radiance profile.

SUMMARY OF THE INVENTION

The principles of the present invention relate to light emitting diodes (and to LED printbars and electrophotographic marking machines that use such light emitting diodes) that have active area geometries that produce compact irradiance profiles. A light emitting diode according to the present invention incorporates electrodes along the outer periphery of their active areas. When used with gradient index lenses, such light emitting diodes can produce light spots having more compact irradiance profiles. When such light emitting diodes and gradient index lenses are incorporated into LED printbars, and when those printbars are used in expose stations of electrophotographic marking machines, improved composite images can result.

BRIEF DESCRIPTION OF THE DRAWINGS

Other aspects of the present invention will become apparent as the following description proceeds and upon reference to the following drawings, in which like reference numerals identify like elements and wherein.

DETAILED DESCRIPTION OF AN EMBODIMENT OF THE INVENTION

This invention relates to light emitting diodes having beneficial active area geometries. A light emitting diode according to the principles of the present invention incorporates electrodes along the outer periphery of their active areas. When used with gradient index lenses, such light emitting diodes can produce light spots having more compact irradiance profiles. When such light emitting diodes and gradient index lenses are incorporated into LED printbars, and when those printbars are used in expose stations of electrophotographic marking machines, improved composite images can result.

Figure 1:
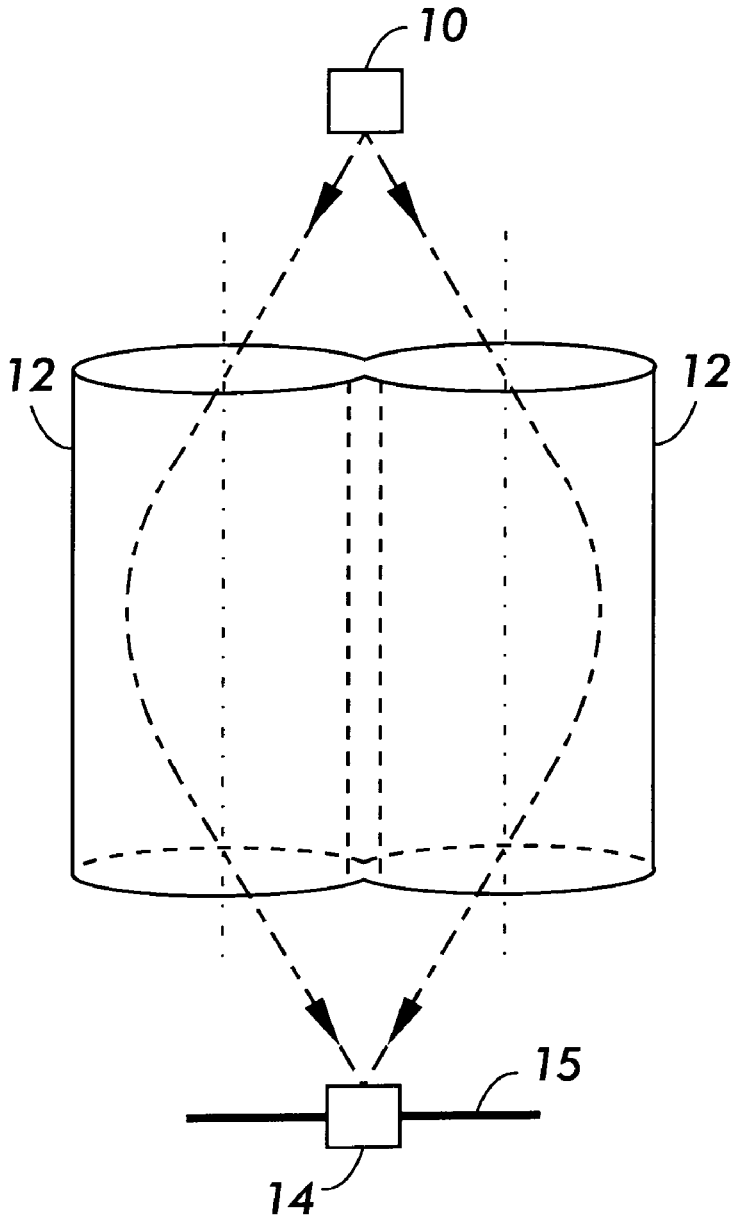
FIG. 1 PRIOR ART
FIG. 1 illustrates the spatial relationship between a light emitting diode of an LED printbar, a gradient-index lens array, and a photoreceptor.
Figure 2:
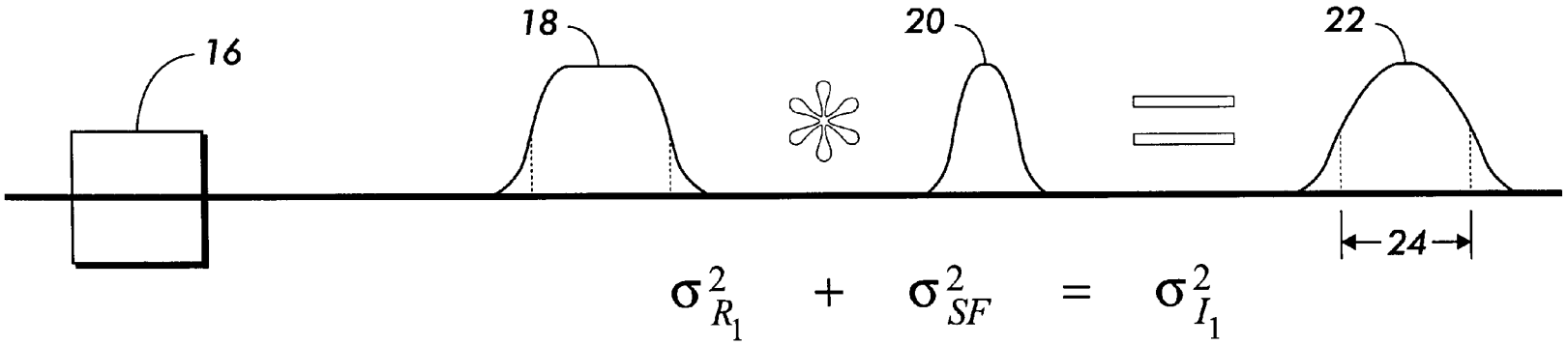
FIG. 2 illustrates irradiance profiles produced using the elements of FIG. 1 with an exemplary active area light emitting diode geometry.
Figure 3:
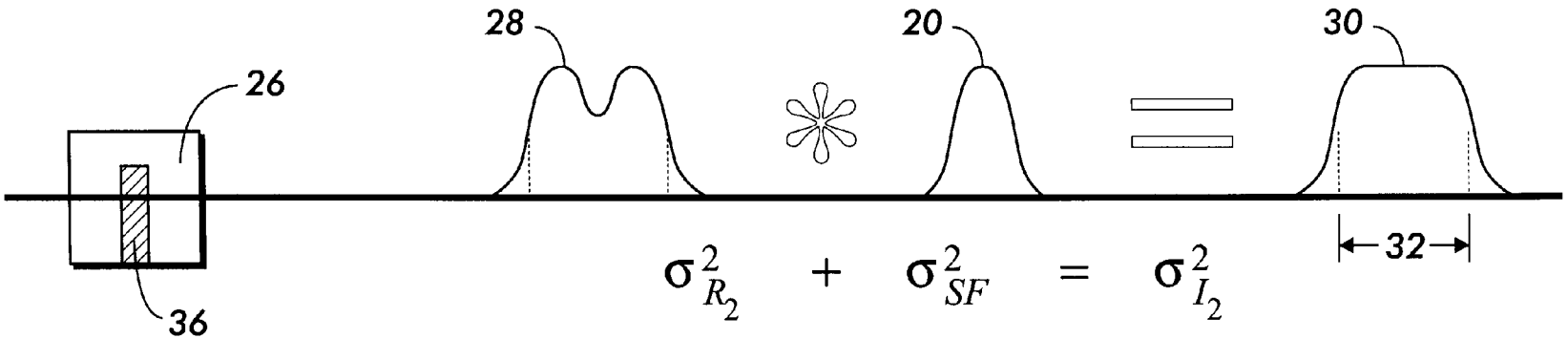
FIG. 3 PRIOR ART
FIG. 3 illustrates irradiance profiles produced using the elements of FIG. 1 when the active area geometry of the light emitting diode is that of a typical prior art light emitting diode.
Figure 4:
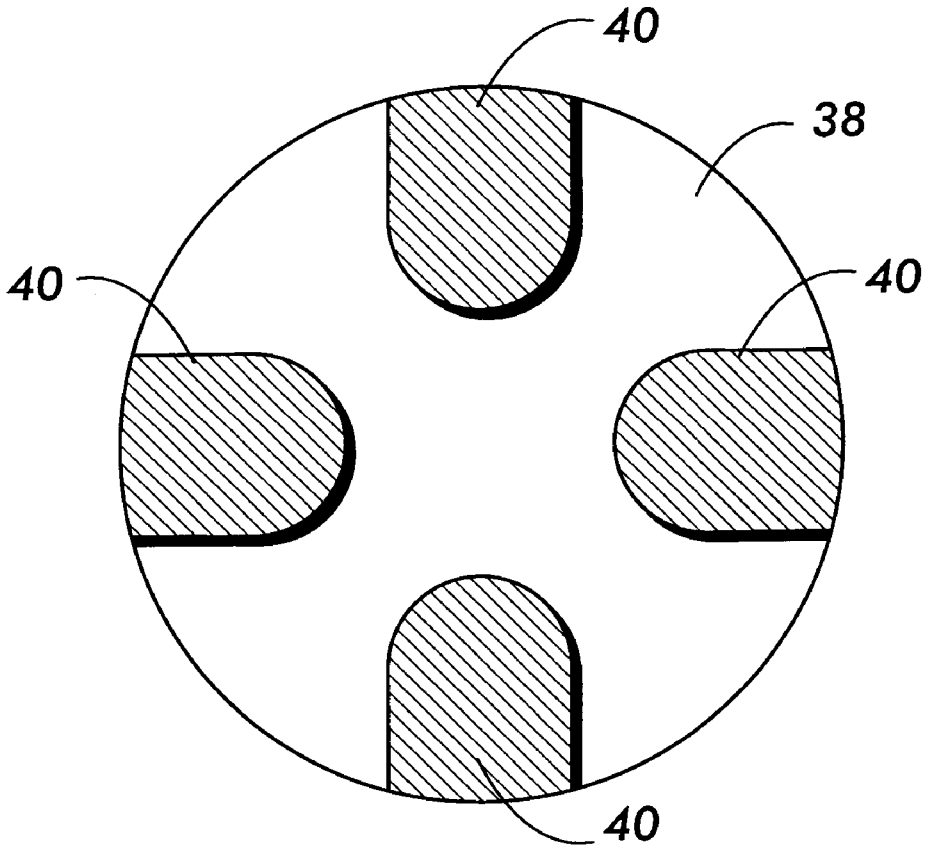
FIG. 4 PRIOR ART
FIG. 4 illustrates a prior art light emitting diode active area geometry.

FIG. 3, previously discussed, shows a typical prior art light emitting diode active area 26. That light emitting includes an electrode 36 that divides the active area 26 in two sections. FIG. 4 shows another typical prior art light emitting diode active area 38. Electrodes 40 interrupt that active area. Such geometries beneficially tend to evenly distribute drive currents over the active area. However, they also tend to interfere with the even production of light from the active area. As explained in the background, when light from such light emitting diodes pass through a gradient index lens the resulting irradiance profile is broader than it would be if the electrodes did not interfere with the production of light from the active area.

Figure 5C:
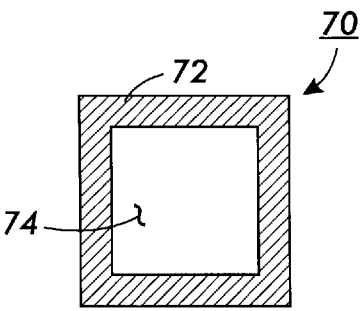
FIGS. 5A–5C illustrate light emitting diode active area geometries that are in accordance with the principles of the present invention.
Figure 5B:
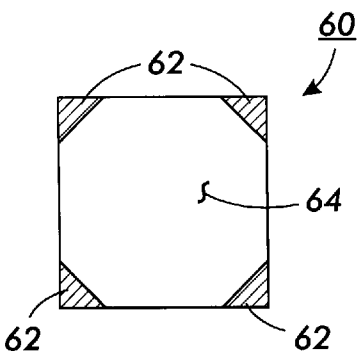
Figure 5A:
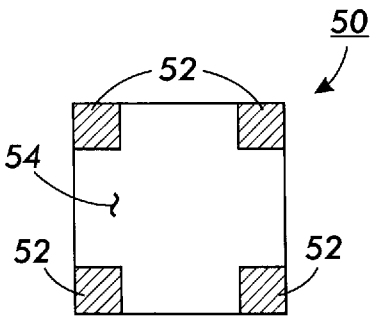
Figure 6C:
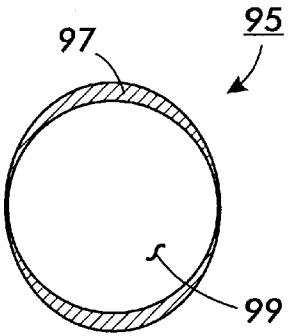
FIGS. 6A–6C illustrate other light emitting diode active area geometries that are in accordance with the principles of the present invention.
Figure 6B:
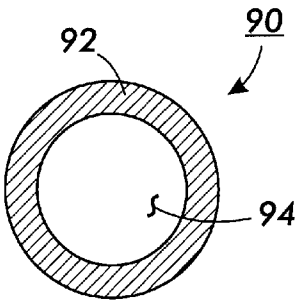
Figure 6A:
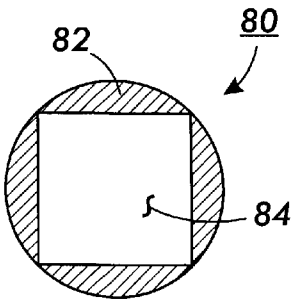

FIGS. 5A–5C and FIGS. 6A–6C illustrate various light emitting diode active area geometries that are in accord with the principles of the present invention and that result in light spots having irradiance profile with reduced FWHM distances. Figure SA shows a light emitting diode 50 having square electrodes 52 in the comers of a square active area 54. FIG. 5B shows a light emitting diode 60 having generally triangular electrodes 62 in the comers of a square active area 64. Figure SC shows a light emitting diode 70 having a square electrode 72 that surrounds a square active area 74. FIG. 6A shows a light emitting diode 80 having a circular electrode 82 that surrounds a square active area 84. FIG. 6B, probably the best overall geometry, shows a light emitting diode 90 having a circular electrode 92 that surrounds a circular active area 94. Finally, FIG. 6C shows a light emitting diode 95 having an elliptical electrode 97 that surrounds a circular active area 99.

Figure 7:
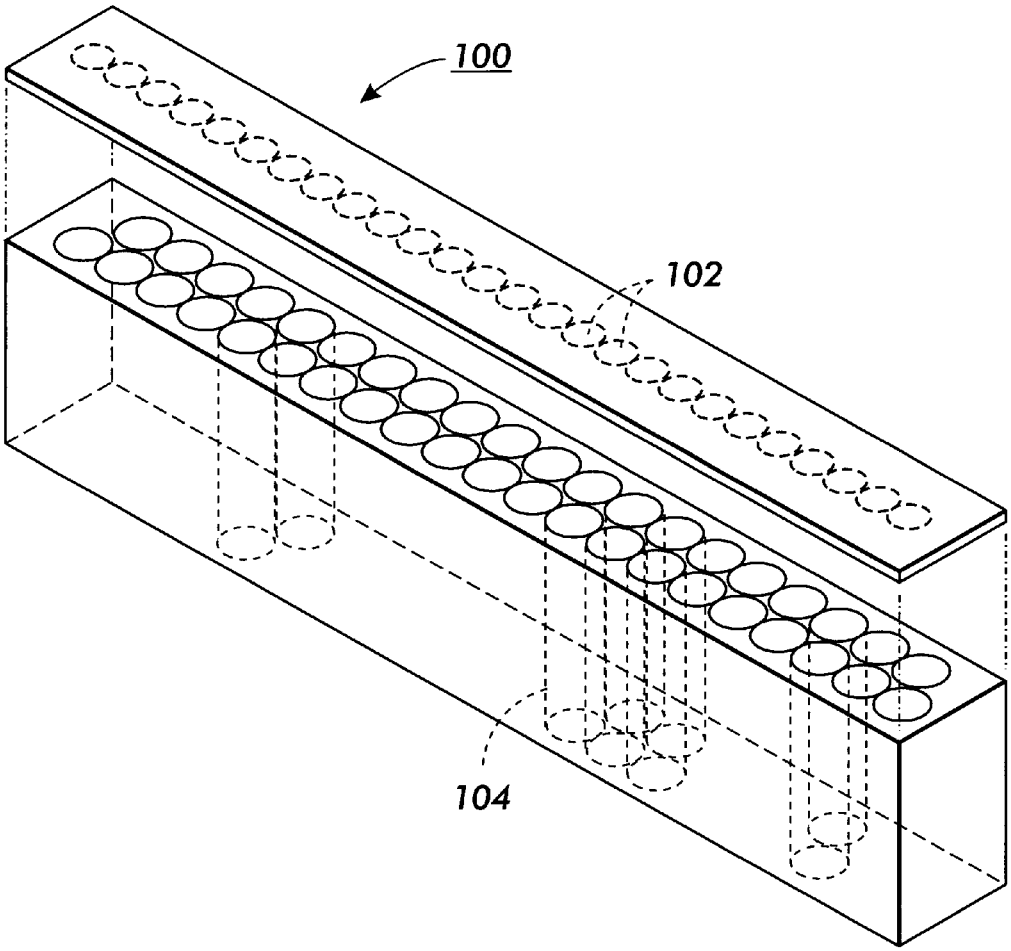
FIG. 7 illustrates an LED printbar that incorporates light emitting diodes that have electrode along their outer periphery.
Figure 8:
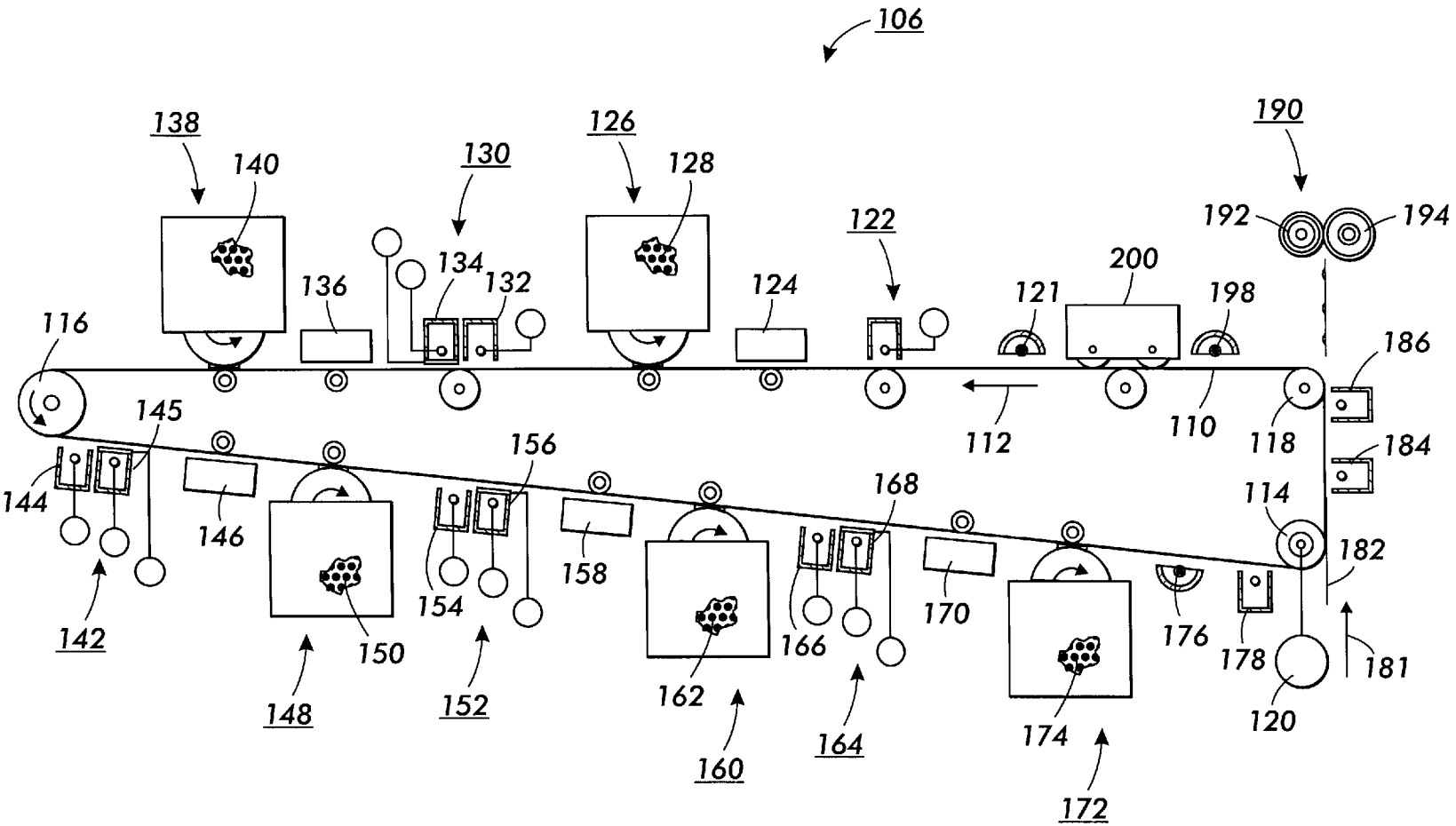
FIG. 8 illustrates an electrophotographic printing machine having LED printbars that are in accordance with FIG. 7.

While light emitting diodes having an electrode along their outer periphery may be beneficial in other applications, they are particularly useful in LED printbars. FIG. 7 illustrates a linear printbar array 100 that incorporates an array of light emitting diodes 102 and a gradient index array 104. Each light emitting diode 102 has an electrode along its outer periphery (not shown in FIG. 7, reference FIG. 5A–6C). Such LED printbars are beneficial in electrophotographic printing machines. One such machine is the printing machine 106 illustrated in FIG. 8.

The printing machine 106 is a single pass, Recharge-Expose-and-Develop, Image-on-Image (REaD 101) printer that develops up to five toner layers for a particular image. However, it is to be understood that the printing machine 106 is exemplary only. The principles of the present invention may be beneficial in many other types of machines. For example, in black and white printers and/or in digital copiers.

The printing machine 106 includes an Active Matrix (AMAT) photoreceptor belt 110 which travels in the direction indicated by the arrow 112. Belt travel is brought about by mounting the photoreceptor belt about a driven roller 114 and tension rollers 116 and 118. The driven roller 114 is rotated by a motor 120.

As the photoreceptor belt travels each part of it passes through each of the subsequently described process stations. For convenience, a single section of the photoreceptor belt, referred to as the image area, is identified. The image area is that part of the photoreceptor belt which is to receive the various actions and toner layers that produce the final composite color image. While the photoreceptor belt may have numerous image areas, since each image area is processed in the same way a description of the processing of one image area suffices to explain the operation of the printing machine 106.

The imaging process begins with the image area passing a "precharge" erase lamp 121 that illuminates the image area to erase any residual charge that might exist on the image area. Such erase lamps are common in high quality systems and their use for initial erasure is well known.

As the photoreceptor belt continues its travel the image area passes a charging station comprised of a DC corotron 122. The DC corotron charges the image area in preparation for exposure to create a latent image for black toner. For example, the DC corotron might charge the image area to a substantially uniform potential of about −500 volts. It should be understood that the actual charge placed on the photoreceptor will depend upon many variables, such as the black toner mass that is to be developed and the settings of the black development station (see below).

After passing the charging station the image area advances to a first light emitting diode based exposure station 124. That exposure station, which incorporates light emitting diodes having electrodes around their outer periphery, exposes the charged image area such that an electrostatic latent representation of a black image is produced. For example, the exposed portions of the image area might be reduced in potential to −50V (while the unexposed portions remain at −500V).

After passing the exposure station 124 the now exposed image area with its black latent image passes a black development station 126 that advances black toner 128 onto the image area so as to produce a black toner image. While the black development station 126 could be a magnetic brush developer, a scavengeless developer may be somewhat better. One benefit of scavengeless development is that it does not disturb previously deposited toner layers. Developer biasing is such as to effect discharged area development (DAD) of the lower (less negative) of the two voltage levels on the image area. Therefore, the charged black toner 128 adheres to the exposed areas of the image area.

After passing the black development station 126 the image area advances to a recharging station 130 comprised of a DC corotron 132 and an AC scorotron 134. The recharging station recharges the image area and its black toner layer using a technique known as split recharging. Split recharging is described in U.S. Pat. No. 5,600,430, which issued on Feb. 4, 1997, and which is entitled, "Split Recharge Method and Apparatus for Color Image Formation." Briefly, the DC corotron 132 overcharges the image area to a voltage level greater than that desired when the image area is recharged, while the AC scorotron 134 reduces that voltage level to that which is desired. Split recharging serves to substantially eliminate voltage differences between toned areas and untoned areas and to reduce the level of residual charge remaining on the previously toned areas. This benefits subsequent development by different toners. Of course, other recharging schemes could also be used.

The now recharged image area with its black toner layer then advances to a second light emitting diode based exposure station 136. That exposure station, which incorporates light emitting diodes having electrodes around their outer periphery, exposes the recharged image area such that electrostatic latent representation of a yellow image is produced. Significantly, the second light emitting diode based exposure station 136 is controlled such that the yellow image is in registration with the black toner image on the image area.

The now re-exposed image area then advances to a yellow development station 138 that deposits yellow toner 140 onto the image area. After passing the yellow development station the image area advances to a recharging station 142 where a DC scorotron 144 and an AC scorotron 145 split recharge the image area as described above.

The now recharged image area with its black and yellow toner layers is then exposed by a third light emitting diode based exposure station 146 to produce an electrostatic latent representation of a magenta image. Again, that exposure station incorporates light emitting diodes having electrodes around their outer periphery. Significantly, the third light emitting diode based exposure station 146 is controlled such that the magenta image is in registration with the black toner image and the yellow toner image on the image area.

After passing the magenta exposure station the now re-exposed image area advances to a magenta development station 148 that deposits magenta toner 150 onto the image area. After passing the magenta development station the image area advances to another recharging station 152 where a DC corotron 154 and an AC scorotron 156 split recharge the image area as previously described.

The recharged image area with its three toner layers then advances to a fourth light emitting diode based exposure station 158. That exposure station, which incorporates light emitting diodes having electrodes around their outer periphery, exposes the now recharged image area such that an electrostatic latent representation of a cyan image is produced. Significantly, the fourth light emitting diode based exposure station 158 is controlled such that the cyan image is in registration with the black, yellow, and magenta toner images already on the image area.

After passing the fourth light emitting diode based exposure station 158 the re-exposed image area advances past a cyan development station 160 that deposits cyan toner 162 onto the image area.

After passing the cyan development station the image area advances to another recharging station 164 where a DC corotron 166 and an AC scorotron 168 once again split recharge the image area as previously described.

The recharged image area with its four toner layers then advances to a fifth light emitting diode based exposure station 170. That exposure station, which incorporates light emitting diodes having electrodes around their outer periphery, exposes the now recharged image area such that an electrostatic latent representation for a special toner is produced. The special toner might be custom fabricated to meet the special requirements of the operator of the printing machine 106. Significantly, the fifth light emitting diode based exposure station 170 is controlled such that the special electrostatic latent is in registration with the black, yellow, magenta, and cyan toner images already on the image area.

After passing the fifth light emitting diode based exposure station 170 the reexposed image area advances past a special development station 172 that deposits special toner 174 onto the image area.

At this time as many as five toner layers might be on the image area, resulting in a final, composite color image. However, that composite color image is comprised of individual toner particles that have charge potentials that may vary widely. Directly transferring such a composite toner image onto a substrate would result in a degraded final image. Therefore it is beneficial to prepare the composite color toner image for transfer.

To prepare for transfer a pretransfer erase lamp 176 discharges the image area to produce a relatively low charge level on the image area. The image area then passes a pretransfer DC scorotron 178 that performs a pre-transfer charging function. The image area continues to advance in the direction 112 past the driven roller 114. A substrate 182 moving in the direction 181 is then placed over the image area using a sheet feeder (which is not shown). As the image area and the substrate continue their travels they pass a transfer corotron 184 that applies positive ions onto the back of the substrate 182. Those ions attract the negatively charged toner particles onto the substrate.

As the substrate continues its travel is passes a detack corotron 186. That corotron neutralizes some of the charge on the substrate to assist the separation of the substrate from the photoreceptor 110. As the lip of the substrate 182 moves around the tension roller 118 the lip separates from the photoreceptor. The substrate is then directed into a fuser 190 where a heated fuser roller 192 and a pressure roller 194 create a nip through which the substrate 182 passes. The combination of pressure and heat at the nip causes the composite color toner image to fuse into the substrate. After fusing, a chute, not shown, guides the substrate to a catch tray, also not shown, for removal by an operator.

After the substrate 182 is separated from the photoreceptor belt 110 the image area continues its travel and passes a preclean erase lamp 198. That lamp neutralizes most of the charge remaining on the photoreceptor belt. After passing the preclean erase lamp the residual toner and/or debris on the photoreceptor is removed at a cleaning station 200. The image area then passes once again to the precharge erase lamp 121 and the start of another printing cycle.

It is to be understood that while the figures and the above description illustrate the present invention, they are exemplary only. Others who are skilled in the applicable arts will recognize numerous modifications and adaptations of the illustrated embodiments that will remain within the principles of the present invention. Therefore, the present invention is to be limited only by the appended claims.

What is claimed:

1. A light emitting diode printbar, comprising:

an array of light emitting diodes, each diode having a substantially rectangular light emitting active area and at least one substantially circular electrode located at the periphery of said active area; and a lens array for focusing light from each light emitting active area into a focal plane.

2. A light emitting diode printbar according to claim 1, wherein said lens array is comprised of a plurality of gradient index lenses.

3. A light emitting diode printbar, comprising:

an array of light emitting diodes, each diode having a substantially rectangular light emitting active area and at least one substantially triangular electrode located at the periphery of said active area; and a lens array for focusing light from each light emitting active area into a focal plane.

4. A light emitting diode printbar according to claim 3, wherein said lens array is comprised of a plurality of gradient index lenses.

5. A light emitting diode printbar, comprising:

an array of light emitting diodes, each diode having a substantially circular light emitting active area and at least one electrode located at the periphery of said active area; and a lens array for focusing light from each light emitting active area into a focal plane.

6. A light emitting diode printbar according to claim 5, wherein said lens array is comprised of a plurality of gradient index lenses.

7. A light emitting diode printbar according to claim 5, wherein said at least one electrode is substantially rectangular.

8. A light emitting diode printbar according to claim 5, wherein said at least one electrode is substantially triangular.

9. A light emitting diode printbar according to claim 5, wherein said at least one electrode is substantially circular.

10. A printing machine comprising:

a photoreceptor;

a charging device, adjacent said photoreceptor, for charging said photoreceptor;

a light emitting diode printbar adjacent said photoreceptor, said light emitting diode printbar including an array of light emitting diodes, each having a substantially rectangular light emitting active area and at least one substantially triangular electrode located at the periphery of said active area, and a lens array for focusing light from each light emitting active area onto said charged photoreceptor so as to produce a latent image; and a developing station adjacent said photoreceptor for depositing toner onto said latent image.

11. A printing machine according to claim 10, wherein said lens array is comprised of a plurality of gradient index lenses.

12. A printing machine comprising:

a photoreceptor;

a charging device, adjacent said photoreceptor, for charging said photoreceptor;

a light emitting diode printbar adjacent said photoreceptor, said light emitting diode printbar including an array of light emitting diodes, each having a substantially rectangular light emitting active area and at least one substantially circular electrode located at the periphery of said active area, and a lens array for focusing light from each light emitting active area onto said charged photoreceptor so as to produce a latent image; and a developing station adjacent said photoreceptor for depositing toner onto said latent image.

13. A printing machine according to claim 12, wherein said lens array is comprised of a plurality of gradient index lenses.

14. A printing machine comprising:

a photoreceptor;

a charging device, adjacent said photoreceptor, for charging said photoreceptor;

a light emitting diode printbar adjacent said photoreceptor, said light emitting diode printbar including an array of light emitting diodes, each having a substantially circular light emitting active area and at least one electrode located at the periphery of said active area, and a lens array for focusing light from each light emitting active area onto said charged photoreceptor so as to produce a latent image; and a developing station adjacent said photoreceptor for depositing toner onto said latent image.

15. A light emitting diode printbar according to claim 14, wherein said at least one electrode is substantially triangular.

16. A light emitting diode printbar according to claim 14, wherein said at least one electrode is substantially circular.

17. A printing machine according to claim 14, wherein said lens array is comprised of a plurality of gradient index lenses.

* * * * *